US006637698B1

(12) United States Patent
Huang

(10) Patent No.: US 6,637,698 B1
(45) Date of Patent: Oct. 28, 2003

(54) HOSE GUIDING DEVICE OF A HOSE WINDER

(75) Inventor: Huang-Fu Huang, Changhua Hsien (TW)

(73) Assignee: Chean I Co.,Ltd., Changhua Hsien (TW)

( * ) Notice: Subject to any disclaimer, the term of this patent is extended or adjusted under 35 U.S.C. 154(b) by 0 days.

(21) Appl. No.: 10/326,303

(22) Filed: Dec. 23, 2002

(51) Int. Cl.[7] ..... B65H 57/14
(52) U.S. Cl. ..... 242/615.2; 242/397.5
(58) Field of Search ..... 242/615, 615.1, 242/615.2, 615.3, 397, 397.5, 588, 405, 405.1

(56) References Cited

U.S. PATENT DOCUMENTS 850,012 A * 4/1907 Jogerst ..... 242/397.5
3,072,384 A * 1/1963 Apichell ..... 242/615.2
3,722,772 A * 3/1973 Flowers et al. ..... 242/615.3
4,220,293 A * 9/1980 Gename ..... 242/397
4,251,038 A * 2/1981 Gename ..... 242/397.5
4,306,688 A * 12/1981 Hechler, IV ..... 242/397
4,756,486 A * 7/1988 Campbell ..... 242/397
5,836,539 A * 11/1998 Grimm et al. ..... 242/615.3

* cited by examiner

*Primary Examiner*—William A. Rivera
(74) *Attorney, Agent, or Firm*—Harrison & Egbert

(57) ABSTRACT

A hose winder includes a frame, and a hose guiding device which is prefabricated and disposed in a chamber of the frame. The hose guiding device includes a first roller mounted on a first shaft, and a second roller mounted on a second shaft. The first shaft is slidably disposed in a first inclined track. The second shaft is slidably disposed in a second inclined track. The distance between two corresponding points of the two inclined tracks is variable, thereby enabling hoses of various specifications to be reeled out and reeled in between the first roller and the second roller.

2 Claims, 4 Drawing Sheets

HOSE GUIDING DEVICE OF A HOSE WINDER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a hose winder, and more particularly to a hose guiding device which is used to facilitate the winding of the hose on a reel of the hose winder and the unwinding of the hose from the reel of the hose winder.

BACKGROUND OF THE INVENTION

As shown in FIG. 5, a hose winder of the prior art is provided with a guide hole 40 in communication with a chamber 41 in which a first roller 43 is mounted on a shaft 42 and a second roller 44 is mounted on another shaft 42. The two rollers 43 and 44 are opposite to each other and are separated from each other by a gap equal to the thickness of a flattened hose 45 of the hose winder. The hose 45 runs through the gap between the two rollers 43 and 44 when the hose 45 is reeled out or reeled in via the guide hole 40. When the hose 45 is reeled in after use, the hose 45 is flattened by the two rollers 43 and 44 so as to eject the residual fluid of the hose 45. The two rollers 43 and 44 are susceptible to being jammed by a foreign object that is attached to the hose 45 at the time when the hose 45 is being reeled in. The gap between the two rollers 43 and 44 is fixed. As a result, the prior art hose winder is not compatible with hoses of various specifications.

BRIEF SUMMARY OF THE INVENTION

The primary objective of the present invention is to provide a hose winder with a hose guiding device which is free of the deficiencies of the prior art hose winder described above.

In keeping with the principle of the present invention, the foregoing objective of the present invention is attained by a hose guiding device comprising a housing in which two rollers are mounted respectively on a shaft slidable along an inclined track of a predetermined length. The hose guiding device is prefabricated for fast assembly with a hose winder frame and is compatible with hoses of various specifications.

The features and the advantages of the present invention will be more readily understood upon a thoughtful deliberation of the following detailed description of a preferred embodiment of the present invention with reference to the accompanying drawings.

BRIEF DESCRIPTION OF THE SEVERAL VIEWS OF THE DRAWINGS

FIG. 3 is a sectional schematic view of the preferred embodiment of the present invention in action such that the hose is being reeled in.

DETAILED DESCRIPTION OF THE INVENTION

Figure 1:
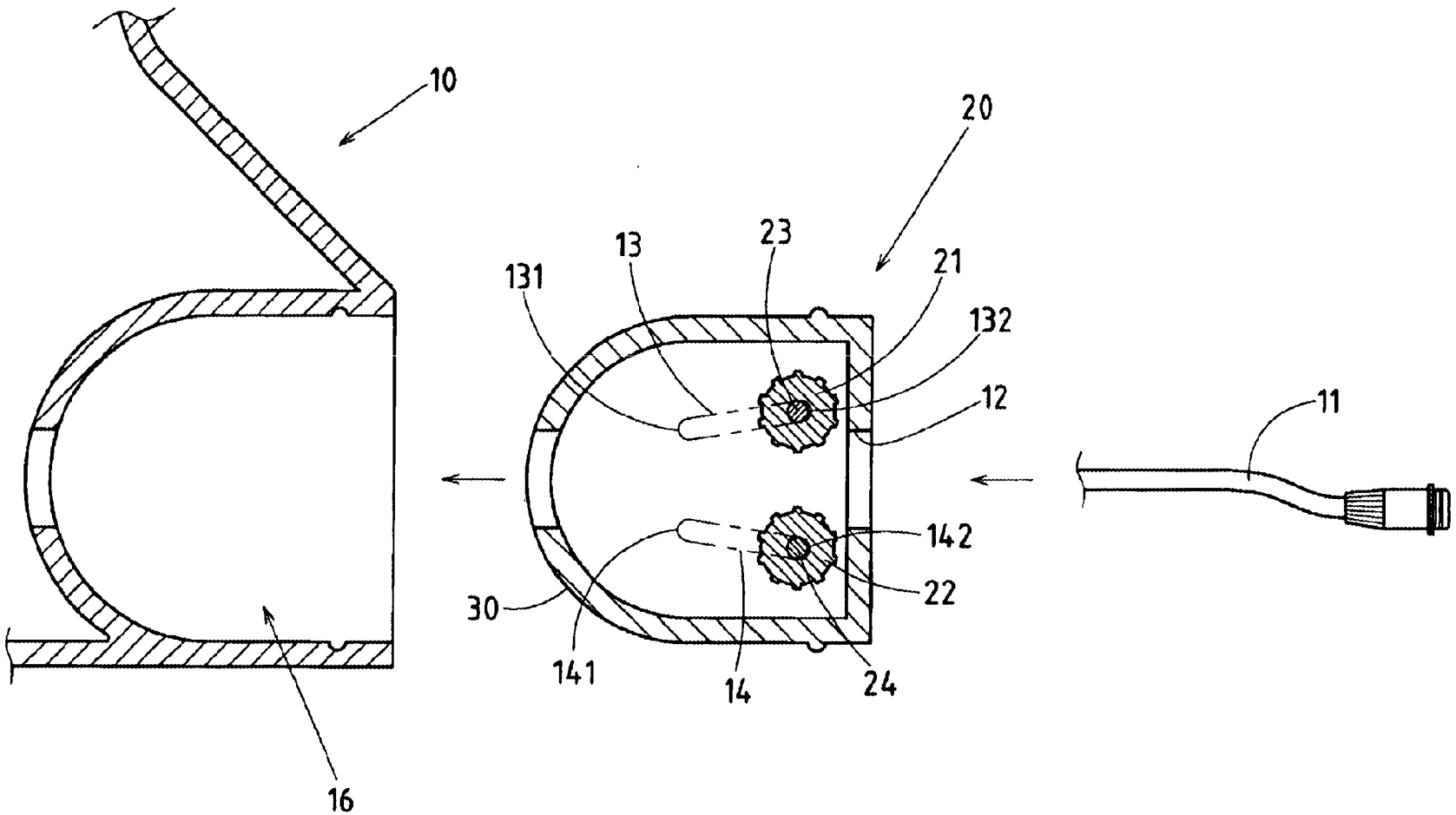
FIG. 1 shows a partial exploded perspective view of the preferred embodiment of the present invention.
Figure 2:
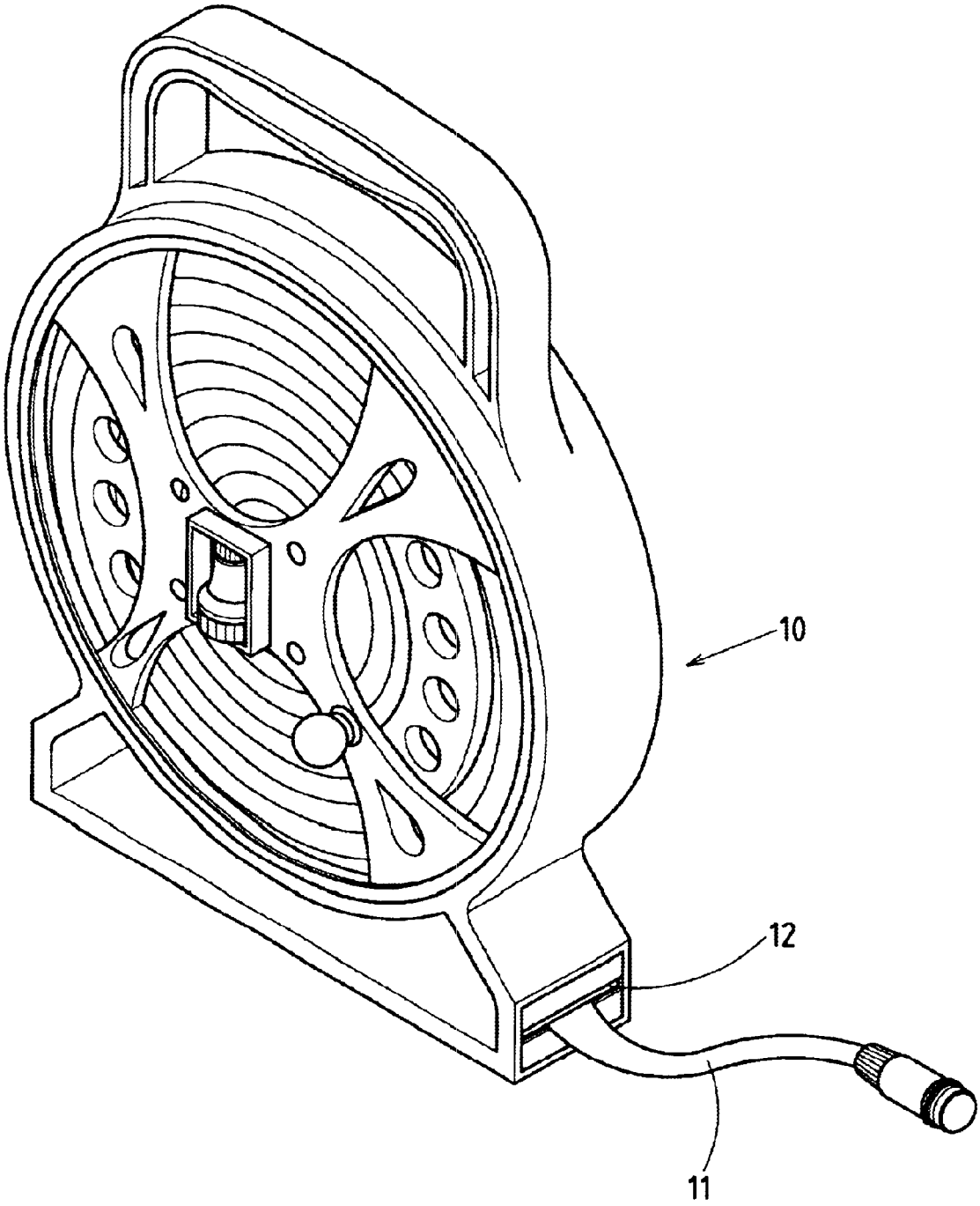
FIG. 2 shows a perspective view of the preferred embodiment of the present invention.

As shown in FIGS. 1–4, a hose winder of the present invention comprises a frame 10 having a chamber 16, and a hose guiding device 20 which is made separately and disposed in the chamber 16 of the frame 10.

The hose guiding device 20 comprises a housing 30, a first roller 21, and a second roller 22. The housing 30 is provided with an opening 12. The first roller 21 is mounted on a first shaft 23 while the second roller 22 is mounted on a second shaft 24. The first shaft 23 and the second shaft 24 are slidably mounted in the housing 30 such that they are variably separated by virtue of a first inclined track 13 and a second inclined track 14. In another words, the first shaft 23 is slidably disposed in the first inclined track 13, whereas the second shaft 24 is slidably disposed in the second track 14. The first inclined track 13 has an inner end 131 and an outer end 132. The second inclined track 14 has an inner end 141 and an outer end 142. The distance between the inner ends 131 and 141 is smaller than the distance between the outer ends 132 and 142. In another words, the distance between the first inclined track 13 and the second inclined track 14 becomes gradually smaller toward the inner ends from the outer ends which are contiguous to the opening 12 of the housing 30. As a result, the distance between the first roller 21 and the second roller 22 becomes gradually smaller toward the first inner end 131 and the second inner end 141 from the first outer end 132 and the second outer end 142.

Figure 3:
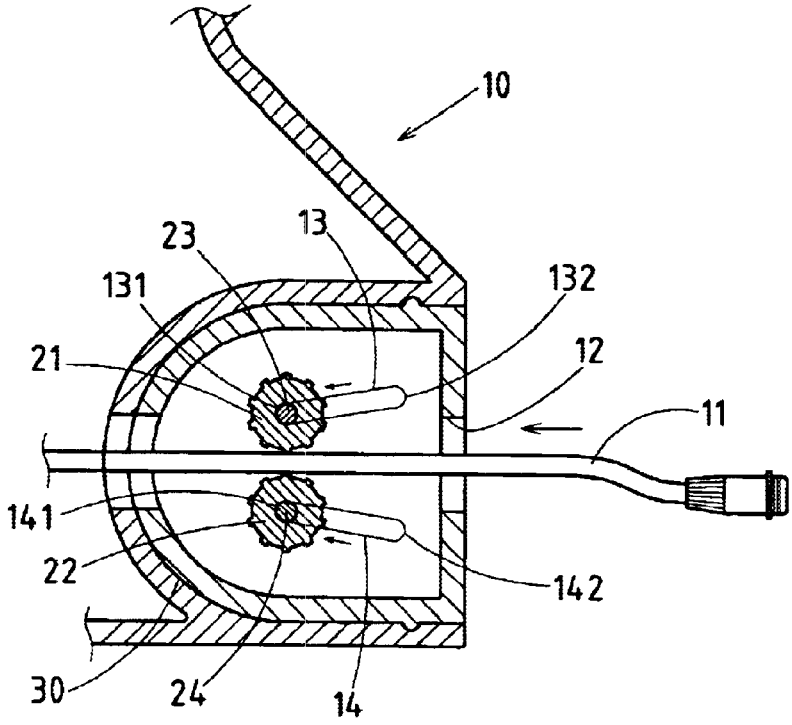

As shown in FIG. 3, a hose 11 is reeled in via the opening 12 such that the hose 11 runs through the gap between the first roller 21 and the second roller 22, which are respectively located at the first inner end 131 of the first inclined track 13, and the second inner end 141 of the second inclined track 14. As a result, the hose 11 is pressed against by the first roller 21 and the second roller 22.

Figure 4:
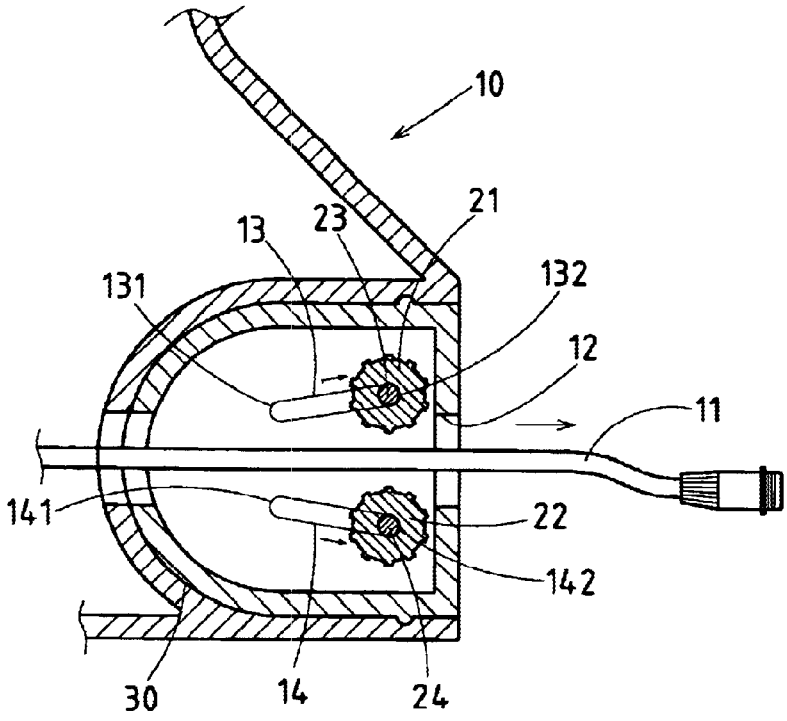
FIG. 4 shows a sectional schematic view of the preferred embodiment of the present invention in action such that the hose is being reeled out.
Figure 5:
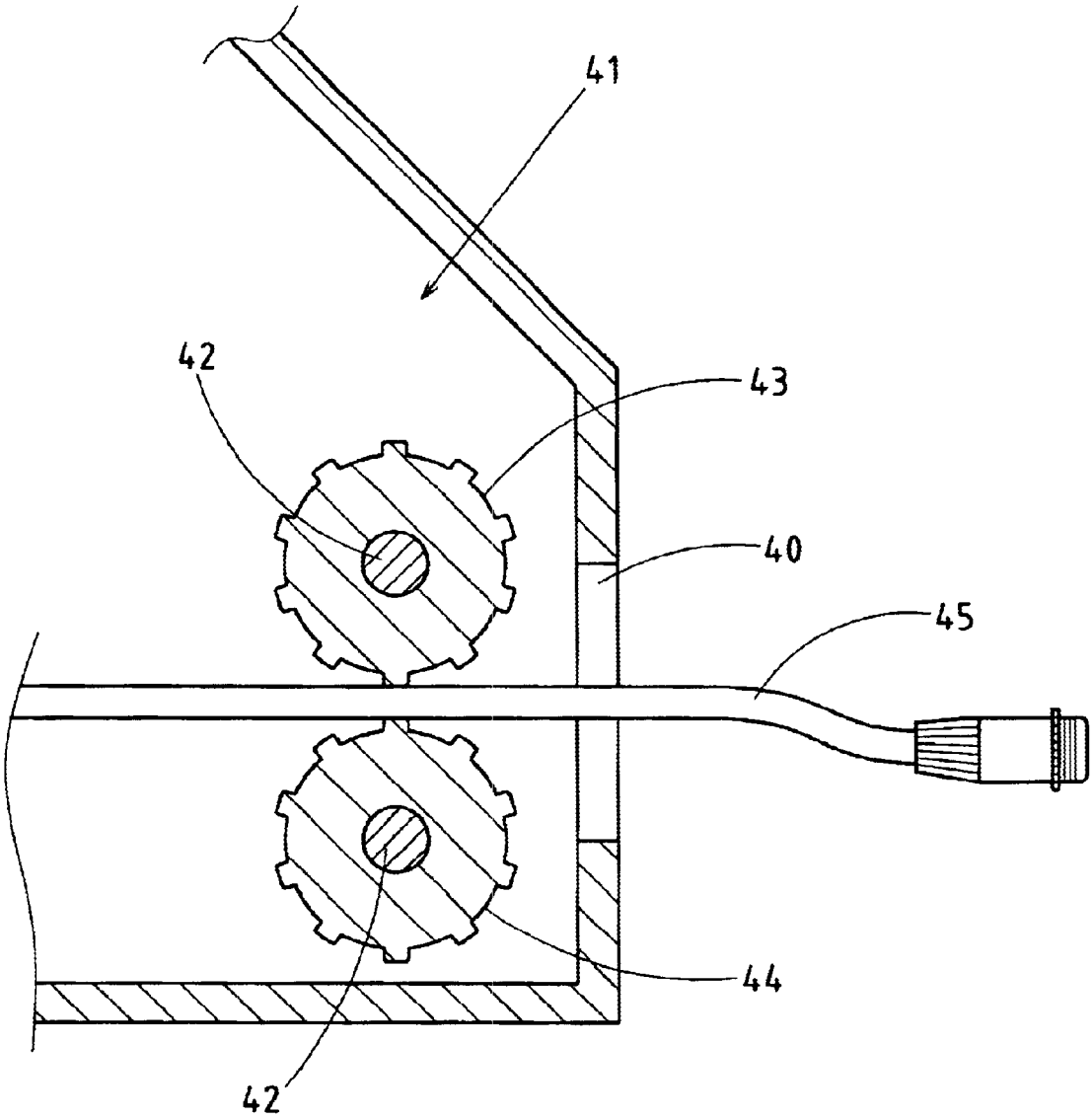
FIG.5 PRIOR ART
FIG. 5 shows a sectional schematic view of a prior art hose winder in action.

As shown in FIG. 4, the hose 11 is reeled out via the opening 12 such that the hose 11 runs through the gap between the first roller 21 and the second roller 22, which are located respectively at the first outer end 132 of the first inclined track 13 and the second outer end 142 of the second inclined track 14. As a result, the hose 11 is not pressed against by the first roller 21 and the second roller 22.

In light of the first roller 21 and the second roller 22 being mounted respectively on the first shaft 23 and the second shaft 24, which are in turn disposed slidably and respectively in the first inclined track 13 and the second inclined track 14, the distance between the first roller 21 and the second roller 22 is variable to accommodate hoses of various specifications. In addition, the rollers 21 and 22 are not vulnerable to being jammed by a foreign object that is attached to the hose 11, thanks to the variable gap between the two rollers 21 and 22.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A hose winder comprising:

a frame provided in an interior with a chamber; and a hose guiding device disposed in said chamber of said frame and comprised of a housing, a first roller, and a second roller, said housing comprised of an opening via which a hose is reeled in and reeled out, said first roller being mounted on a first shaft located in said housing, said second roller being mounted on a second shaft located in said housing such that said second roller is opposite in location to said first roller, and such that said second roller is separated from said first roller by a gap corresponding in location to said opening of said housing, said first roller and said second roller serving to exert pressure on the hose which runs through the gap at such time when the hose is being reeled in;

wherein said first shaft is slidably disposed in a first inclined track of a length such that said first shaft slides between a first inner end and a first outer end of said first inclined track, with said first outer end being located in proximity of said opening of said housing; wherein said second shaft is slidably disposed in a second inclined track corresponding in length to said first inclined track, said second shaft sliding between a second inner end and a second outer end of said second inclined track, with said second outer end being located in proximity of said opening of said housing whereby said second outer end of said second inclined track is separated from said first outer end of said first inclined track by a distance greater than a distance separating said second inner end of said second inclined track from said first inner end of said first inclined track; and wherein said first roller and said second roller exert pressure on the hose at such time when said first shaft and said second shaft are respectively located at said first inner end of said first inclined track and said second inner end of staid second inclined track.

2. The hose winder as defined in claim 1, wherein said hose guiding device is prefabricated.

* * * * *